US011261679B1

(12) United States Patent
Alali et al.

(10) Patent No.: US 11,261,679 B1
(45) Date of Patent: Mar. 1, 2022

(54) METHOD AND APPARATUS TO CURE DRILLING LOSSES WITH AN ELECTRICALLY TRIGGERED LOST CIRCULATION MATERIAL

(71) Applicant: SAUDI ARABIAN OIL COMPANY, Dhahran (SA)

(72) Inventors: Ammar Alali, Dhahran (SA); Amjad Alshaarawi, Dhahran (SA); Abeer Al-Olayan, Dhahran (SA); Haytham H. Alhamed, Al Khubar (SA); Abdulwahab Al-Johar, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/003,162

(22) Filed: Aug. 26, 2020

(51) Int. Cl.
*E21B 21/00* (2006.01)
*E21B 33/12* (2006.01)
*E21B 33/138* (2006.01)

(52) U.S. Cl.
CPC ..... *E21B 21/003* (2013.01); *E21B 33/1204* (2013.01); *E21B 33/138* (2013.01)

(58) Field of Classification Search
CPC ..... E21B 7/15; E21B 21/003; E21B 21/062; E21B 21/00; E21B 21/08; E21B 43/16;
(Continued)

(56) References Cited

U.S. PATENT DOCUMENTS 6,926,089 B2 8/2005 Goodson, Jr. et al.
7,322,416 B2 1/2008 Burris, II et al.
(Continued)

FOREIGN PATENT DOCUMENTS

BE 1017310 A5 6/2008
CA 2416964 A1 7/2003
(Continued)

OTHER PUBLICATIONS

"BISN Bridge Plug Video", Jul. 2014, Internet URL: https://www.youtube.com/watch?v=tcVFSV-Hdf8 (1 page).
(Continued)

*Primary Examiner* — Zakiya W Bates
(74) *Attorney, Agent, or Firm* — Osha Bergman Watanabe & Burton LLP

(57) ABSTRACT

Provided is a system for emplacing an electrically activated lost circulation material within a wellbore. The system may comprise a bottom hole assembly connected to a drill string, with an activation tool that may be provided along the bottom hole assembly. The system may comprise an activation tool with a non-conductive isolation sleeve having an inner bore, electrodes exposed to an outer surface of the isolation sleeve, conductive cables electrically connecting the electrodes to one of an anode terminal and a cathode terminal, and a seat extending into the inner bore. Further provided is a method for plugging a loss zone in a wellbore that may use at least one activation tool. The method may include circulating an electrically activated lost circulation material to the loss zone and delivering electricity from a power source to electrodes of the activation tool to solidify the electrically activated lost circulation material.

20 Claims, 3 Drawing Sheets

(58) Field of Classification Search
CPC ..... E21B 43/25; E21B 47/10; E21B 10/00; E21B 17/003
See application file for complete search history.

(56) References Cited

U.S. PATENT DOCUMENTS

| | | | |
|---|---|---|---|
| 10,024,135 | B2 | 7/2018 | Pettersen et al. |
| 2007/0029197 | A1 | 2/2007 | DiFoggio et al. |
| 2014/0224480 | A1 | 8/2014 | Nguyen et al. |
| 2019/0211640 | A1 | 7/2019 | Saltykov et al. |

FOREIGN PATENT DOCUMENTS

| | | | | |
|---|---|---|---|---|
| CA | 2663495 | A1 * | 3/2008 | ..... E21B 17/028 |
| EP | 2809742 | B1 | 3/2019 | |
| GB | 2411918 | A | 9/2005 | |
| WO | WO-2013070609 | A1 * | 5/2013 | ..... E21B 4/04 |
| WO | 2016/060673 | A1 | 4/2016 | |
| WO | 2019165225 | A1 | 8/2019 | |
| WO | 2019216904 | A1 | 11/2019 | |

OTHER PUBLICATIONS

International Search Report and Written Opinion of the International Searching Authority issued in corresponding International Application No. PCT/US2020/052701, dated Jul. 6, 2021 (20 pages).

* cited by examiner

METHOD AND APPARATUS TO CURE DRILLING LOSSES WITH AN ELECTRICALLY TRIGGERED LOST CIRCULATION MATERIAL

BACKGROUND

In wellbore drilling, a drilling fluid (or drilling mud) is circulated from a surface of the wellbore to downhole through the drill string. The fluid exits through ports (or jets) in the drill bit. The fluid picks up cuttings and carries the cuttings up an annulus formed between an inner wall of the wellbore and an outer wall of the drill string. The fluid and the cuttings flow through the annulus to the surface, where the cuttings may be separated from the fluid. The fluid can be treated with chemicals and then pumped into the wellbore through the drill string to repeat the process.

During the drilling of subterranean wells, such as subterranean wells used in hydrocarbon development operations, drilling mud and other fluids can be pumped into the well. During drilling operations, the wellbore of the subterranean well can pass through a zone that has induced or natural fractures, are cavernous, or otherwise have an increased permeability compared with solid rock. Such a zone is known as a lost circulation zone. In such a case, the drilling mud and other fluids that are pumped into the well can flow into the lost circulation zone and become irretrievable. Thus, lost circulation is a situation in which the flow of the drilling fluid up the annulus toward the surface is reduced or is totally absent.

When unacceptable drilling fluid losses are encountered, lost circulation materials may be introduced into the drilling fluid from the surface. The revised fluid that includes the lost circulation materials is pumped downhole as part of the standard well circulation system. The revised fluid passes through a circulation port to plug and pressure seal the exposed formation at the point where losses are occurring. Once sealing has occurred and acceptable fluid loss control is established, drilling operations can resume.

Many chemical-based lost circulation materials have been proposed in the past, with limited successes, especially during total lost circulation incidents. The main idea is to pump chemicals that would solidify upon reacting. Typically, the reaction rates have been controlled by temperature (temperature-triggered reactions). Alternatively, the industry relied on designing delayed reaction rates. In particular, these chemicals would be mixed and pumped downhole at calculated rates such that the reaction would start by the time they arrive at the lost circulation zone. In other applications, cement might be used as well. Unfortunately, many of these common lost circulation material practices are insufficient, especially in the case of total lost circulation.

SUMMARY

This summary is provided to introduce a selection of concepts that are further described in the detailed description. This summary is not intended to identify key or essential features of the claimed subject matter, nor is it intended to be used as an aid in limiting the scope of the claimed subject matter.

In one aspect, embodiments herein are directed toward a system for emplacing an electrically activated lost circulation material within a wellbore. The system may have an activation tool. The activation tool may include a non-conductive isolation sleeve having an inner bore, electrodes, including anodes and cathodes, exposed to an outer surface of the isolation sleeve. The activation tool may further include conductive cables electrically connecting the electrodes to one of an anode terminal and a cathode terminal, and a seat extending into the inner bore. The system may include an activation system. The activation system may have an activation plug connected to a wireline, where the activation plug may have a shoulder configured to land on the seat of the activation tool. In one or more embodiments, when the activation plug is landed on the seat, conductive cables may be disposed within the activation plug are in electrical connection with one or more of the anode terminal and the cathode terminal, and a power source for providing electricity to the conductive cables may be disposed within the activation plug.

In another aspect, embodiments herein are directed toward a system for emplacing an electrically activated lost circulation material within a wellbore. The system may have a bottom hole assembly connected to a drill string and an activation tool may be provided along the bottom hole assembly. The activation tool may have electrodes, including anodes and cathodes, exposed to an outer surface of the activation tool, and conductive cables electrically connecting the electrodes to one of an anode terminal and a cathode terminal inside the activation tool. The system may have an activation system, including conductive cables that may be disposed within the drill string in electrical connection with one or more of the anode terminal and the cathode terminal. The system may further include a power source that may provide electricity to the conductive cables disposed within the drill string.

In another aspect, embodiments herein relate to a method for plugging a loss zone in a wellbore. The method may include at least one activation tool proximate the loss zone. The at least one activation tool may have a non-conductive isolation sleeve having an inner bore, electrodes, including anodes and cathodes, exposed to an outer surface of the isolation sleeve, and conductive cables electrically connecting the electrodes to one or more electrode terminals. The method may circulate an electrically activated lost circulation material to the loss zone. Further, the method may deliver electricity from a power source to electrodes of the activation tool via the conductive cables to generate an electric field around the electrically activated lost circulation material to solidify the electrically activated lost circulation material.

Other aspects and advantages of the claimed subject matter will be apparent from the following description and the appended claims.

DETAILED DESCRIPTION

Figure 1:
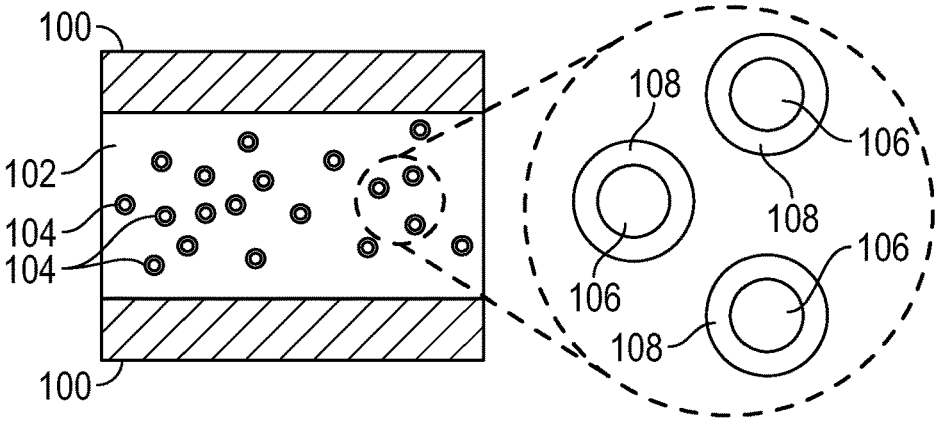
FIG. 1 shows a schematic of the flow of colloidal particles with carrier fluid in the absence of an electric field, according to embodiments herein.

One or more embodiments in accordance with the present disclosure relate to assemblies for electrification of electrically activated lost circulation materials and their methods of use downhole. Systems using downhole activation tool assemblies, electrically activated lost circulation material compositions, and methods of use thereof for producing a gelled solid in a lost circulation zone are described herein. As the electrically activated lost circulation material is applied to and then emerges inside of the formation at a lost circulation zone, a downhole activation tool may be used to deliver a voltage difference. The resulting electric current will flow through the formation with lost circulation and the electrically activated lost circulation material. As the current travels through the electrically activated lost circulation material, the lost circulation material is activated, thereby solidifying into a solid gel. This solidification reaction is trigged by electricity. As the solid gel forms from the lost circulation material, it will block additional losses of drilling mud, plugging the leaking area of the lost circulation zone. The activation tool may then then be disengaged or may be cleaned out, depending on the selected method.

One reason for failure using reactive lost circulation materials is the inaccuracy associated with the timing of triggering the chemical reactions that bring about the solidification reaction, as well as the inaccuracy associated with the placement of the lost circulation material. In contrast, embodiments herein use a novel approach, i.e., electrically triggered lost circulation materials, to control lost circulation incidents. This approach provides a method to inject electrically triggered lost circulation materials and engage a downhole tool to trigger the solidification reaction upon request, with placement at a precise location. Embodiments herein thus advantageously utilize lost circulation materials that can be controlled/triggered electrically. Embodiments herein may also provide a mechanical approach to engage the set of tools, anodes, cathodes and packer(s) to deploy an instant effect at a specific location. Embodiments herein merge electrical, mechanical, and chemical methods in providing systems and methods for lost-circulation.

Electrically Activated Lost Circulation Material

Lost circulation materials useful in embodiments herein include electrically activated lost circulation materials. An electrically activated lost circulation material according to embodiments herein may include electrorheological fluids, for example colloidal suspensions, that change their rheological characteristics, for example viscosity and/or rigidity, in response to an electric field. When an electric field is applied, particles will be induced, their surfaces will be differentially charged, and they will act as di-pole particles. This changes the arrangement of the particles, allowing the particles to form a rigid structure.

The electrorheological fluid that may be used according to embodiments herein is not particularly limited, other than needing the ability to effectively plug a lost circulation zone upon application of an electric field downhole. In one or more embodiments, the electrically activated lost circulation material may include urea coated particles that form a colloidal particle suspension in the absence of an electric field. The lost circulation material may include fine non-conductive particles coated with a nano-layer of urea, for example, suspended in a carrier fluid, such as any type of oil.

A schematic of the flow of colloidal particles with carrier fluid without an electric field applied, according to one or more embodiments, is depicted in FIG. 1. Neutral boundaries 100 in the absence of an electric field surround an electrorheological fluid phase 102. Neutral boundaries are boundaries with no assigned charges. Meaning, neutral boundaries are not negative (−) or positive (+). The fluid phase 102 may include suspended colloidal particles 104 that are core particles 106 with a nano-layer urea coating 108.

Figure 2:
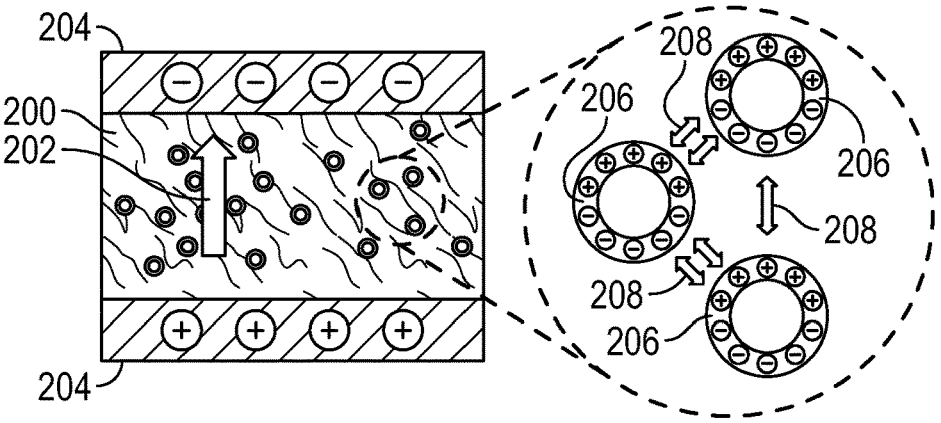
FIG. 2 shows a schematic of the formation of a gel with charged colloidal particles in the presence of an electric field, according to embodiments herein.

When in the presence of an electric field, the urea-coated particles develop charges and aggregate to form a gel, as depicted in the schematic of FIG. 2. The fluid phase forms a gel phase 200 when an electric field is applied 202. During this process, neutral boundaries 100 become charged boundaries 204 and the electric field causes surface charges to build on the urea coated particles. The charged surfaces 206 come together from attraction forces 208 to form a gelled solid.

As described above, electrically activated lost circulation materials according to embodiments herein may be formed from particles in a carrier fluid that are activated by an electric field. The electrorheological suspension of one or more embodiments herein is a colloidal suspension and its rheological properties are not limited to viscosity and rigidity.

The core particles that are used in electrorheological fluids herein are not particularly limited and include materials such as silica, cellulose, and titanium oxide, or combinations thereof. The core particles may be formed from materials that are non-conductive or have very low conductivity, such as 1 millisiemens/centimeter (mS/cm) or less. The core particles are a base upon which a functionalized surface coating is added. The functionalized surface coating of one or more embodiments may be a nano-layer. The addition of the functionalized nano-layer surface may be conducted using well-known synthetic mechanisms used to form a coated particle. The resulting coated particle may comprise or consists of a silica, a cellulose, and/or a titanium oxide core with a nano-layer as the coating. The nano-layer selected should have a property of developing a surface charge in the presence of an electric field. Although this nano-layer can include or may be formed from other components, urea or functionalized urea are the primary components in one or more embodiments.

The particle core may have any suitable particle size for the application, so long as it provides a colloidal suspension in the carrier fluid. In some embodiments, the particle core may be a nanoparticle, including particles having an average diameter (inclusive of average effective diameter for non-spherical particles) in the range from about 0.1 to about 1,000 nm. In other embodiments, the particle core may have an average diameter up to 200 micrometers. In various embodiments, the particle core may have an average diameter in the range from a lower limit of 0.1, 0.5, 1, 10, 50, 100, 150, 200, 250, or 500 nm to an upper limit of 250, 500, 1000, 10000, 50000, 100000, or 150000 nm. The particles as provided may have a dispersed particle size distribution, which may be monodisperse or polydisperse.

The nano-layer may have any suitable layer thickness size for the application, including 0.1-1000 nm, 500-1000 nm, 0.1-500 nm, 1-300 nm, and 10-200 nm. The nano-layer as provided may have a distribution across the multiple particles, and may be monodisperse or polydisperse. In other words, not all particles may have the same thickness, as such coating thicknesses may vary according to the coating process used.

In some embodiments, the electrically activated lost circulation material may include the non-conductive coated particles, a carrier fluid, and a surfactant. The carrier fluid is not particularly limited and can be any type of oil or oil-based fluid, for example, diesel oil, or mineral oil. The surfactant used may be selected to reduce the agglomeration of the particles and assure they are suspended for a longer time in the carrier fluid than if no surfactant were present. The surfactant is not particularly limited and in one or more embodiments may be an acid, for example, one or more of citric acid, hydrochloric acid, and sulfuric acid.

The electrically activated lost circulation material may be capable of developing a surface charge on the particles such that when a current from an applied electric field travels through the carrier fluid, the electrically activated lost circulation material solidifies and turns into a solid gel. A "solid gel" herein is a gelled lost circulation material that has properties such as an increased rigidity compared to a liquid, fluid, liquid gel, or fluid gel. Not wanting to be bound by theory, the electrically activated surface charges may induce a dipole over the particle and attract electrically activated surfaces of other particles that have formed dipoles; these dipole-dipole interactions are thought to induce aggregation of particles within the carrier fluid to form a solid gel. A schematic of this chemical reaction mechanism is shown in FIG. 2, as described above.

Once the electrically activated lost circulation material is pumped to a loss zone, the solidification of the electrically activated lost circulation material may be electrically triggered. For that, both communication and power transfer may be provided through a dedicated tool. For example, the above-described electrically activated lost circulation material may be activated using an electrically activated lost circulation material activation tool according to one or more embodiments herein, described further below, to expose the electrically activated lost circulation material to an electric field.

Electrically Activated Lost Circulation Material Activation Tool

An electrically activated lost circulation material activation tool may be a sub that is equipped with an isolation sleeve, where the sub may be connected to and sent downhole on a drill string. The isolation sleeve may be made from a non-conductive material and includes or accommodates a group of electrodes that may include both anode terminals and cathode terminals, which may also be referred to herein as conductors. The isolation sleeve may have an inner bore, which may be connected to or fitted around the body (e.g., sub) of the activation tool. The electrodes, including anodes and cathodes, may be exposed to an outer surface of the isolation sleeve, and may be electrically connected to terminals via conductive cables. For example, anode and cathode terminals may be provided at a seat extending into the inner bore of the isolation sleeve. The isolation sleeve ensures that the only way for current to flow between the conductors is through the fluid, not through other components of the tool.

Figure 3A:
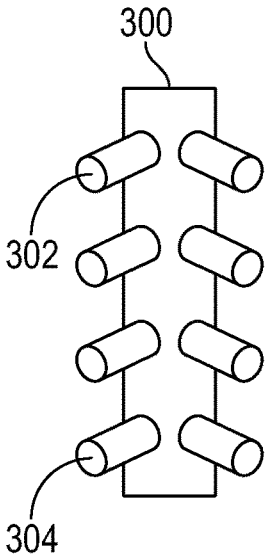
FIGS. 3A-C show different arrangements of conductors on the sleeve of an activation tool, according to one or more embodiments herein.
Figure 3B:
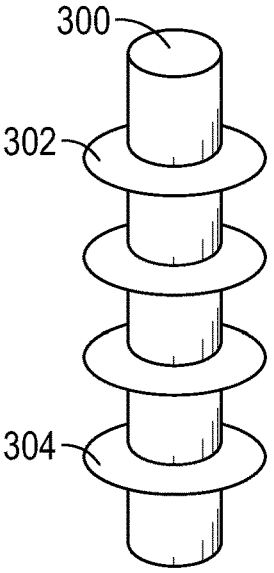
Figure 3C:
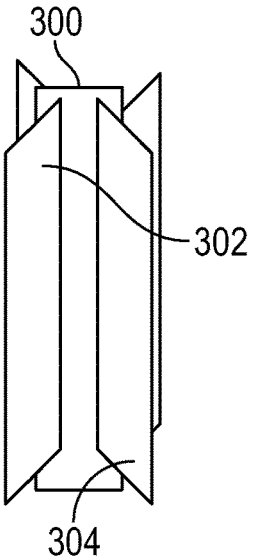

Conductors may be provided around an isolation sleeve in various arrangements, e.g., aligned arrangements, staggered arrangements, and/or scattered arrangements, and have different shapes and sizes, e.g., rod/pin shapes, horizontal or vertical plates, and/or blocked segments. FIGS. 3A-C show examples of an isolation sleeve 300 with different arrangements of conductors including anode terminals 302 and cathode terminals 304. The anode and cathode terminals may be provided, for example, as rods (FIG. 3A), discs (FIG. 3B), or fins (FIG. 3C). Other various configurations for the conductors are contemplated and may be readily envisioned by one skilled in the art based on this disclosure.

In one or more embodiments, conductive cables may pass through the inner bore of the isolation sleeve and connect the conductors to a power source and a communication source. Each of the conductive cables that attach to the conductors of the isolation sleeve are in electrical connection with one of anode terminal(s) or one of cathode terminal(s). Once electrical power is supplied, a voltage difference supplied by an electric field may be applied through the electrically activated lost circulation material and the solidification reaction is activated.

The conductors in one or more embodiments may be affixed to the external surface of the isolation sleeve in a stationary manner. As the activation sub may be run with the drill string, during drilling, stationary conductors (electrodes), such as illustrated in FIGS. 3A-C, may interact with drilling fluid and drill cuttings, and possibly the formation. In such embodiments, the conductors may have a strength and connection (e.g., weld) designed to withstand being run through a drill string.

Alternatively, the conductors in other embodiments may be movable with respect to the isolation sleeve. For example, the conductors may be configured to extend and/or retract with respect to the isolation sleeve. In some embodiments, the conductors may be embedded inside the isolation sleeve, and when needed, may be extended into the wellbore annulus a distance such that it may effectively interact with the electrically activated lost circulation material. The conductors that expand, or expand and retract may be both extendable and retractable from within isolation sleeve using various mechanical, hydraulic, or pneumatic means known in the art. In some embodiments, the conductors may be extended and retracted by hydraulic pressure, which may be activated by a series of ball drops to commence the sequence of operations. Such operations may be similar to that used for extending and retracting under-reamers, for example; however, embodiments herein are not limited to this technique. By using retractable conductors around an isolation sleeve, the conductors may be protected within the isolation sleeve from a surrounding drill string as it is run downhole, and then expanded to interact with electrically activated lost circulation material.

The conductors, including anode terminals and cathode terminals, can have several shapes in different arrangements when either fixedly attached to an isolation sleeve or retractably connected to an isolation sleeve. Non-limiting examples of shapes include rods, pins, fins, spikes, plates, and combinations thereof. Non-limiting examples of arrangements include aligned, staggered, scattered, horizontal, vertical, and combinations thereof. A few of these non-limiting examples of electrode terminal arrangements on the isolation sleeve are shown in FIGS. 3A-C.

In some embodiments, the isolation sleeve may have a fixed outer diameter. In such embodiments, the solidification of the electrically activated lost circulation material around the activation tool may cause the drilling string to be stuck. In these instances, a freeing strategy may be used to free the stuck drill string.

Upon activation of the solidification reaction, the area around the activation tool becomes solid. In some instances, this will cause the activation tool and connected drill string to be stuck. The activation tool, including an isolation sleeve and conductors, in one or more embodiments may be drillable and made from drillable materials such as aluminum or elastomeric materials, among others. For example, in some embodiments, an isolation sleeve may be connected to a sub portion or body of an activation tool using one or more shear pins, or another release mechanism. After solidification of the electrically activated lost circulation material, the isolation sleeve may be disconnected from the body of the activation tool, thereby allowing the activation tool body and connected drill string to move relative to the isolation sleeve stuck in the solidified electrically activated lost circulation material. Drilling equipment may be installed above and/or below the activation tool in order to drill through the disconnected isolation sleeve as the drill string (and connected drilling equipment and activation tool body) is moved relative to the stuck isolation sleeve. For example, clean out tool(s), such as a reamer, may be connected along the drill string in a position to have cutters that face the isolation sleeve. After the electrically activated lost circulation material is solidified and the isolation sleeve is released, one or more clean out tools may be used to drill through the stuck isolation sleeve and core area of the solidified electrically activated lost circulation material around the isolation sleeve in order to drill and clean out a bore through the solidification area.

In other embodiments, the isolation sleeve may be inflatable (expandable) and/or deflatable (contractible). For example, once emplaced, inflation/expansion of the isolation sleeve may be effected via mechanical or pneumatic operations, expanding the isolation sleeve to a larger diameter. In such embodiments, the conductors may also be expandable/retractable from the isolation sleeve, where the conductors may radially expand from the isolation sleeve once in position downhole to activate electrically activated lost circulation material. Inflation/deflation as used herein is used to indicate that the member/conductor may "deform" do to differential pressure, for example. While the concept is similar to the extendible and retractable conductors discussed above, the mechanism and design of the components are dissimilar. Following solidification of the gel, the conductors and the isolation sleeve may be deflated (contracted) to the smaller transport diameter, thus freeing the activation tool and allowing drilling to continue following cleanout of the gel in the wellbore annulus. In this manner, an activation tool may be used multiple times during a drilling operation.

The activation tool of one or more embodiments may be part of a bottom hole assembly used to drill a wellbore. In such embodiments, the activation tool may be used during a drilling operation when a loss zone is encountered. In some embodiments, a bottom hole assembly dedicated to drilling a wellbore may be provided without an activation tool to drill the wellbore. In these embodiments, when a loss zone is reached, the dedicated drilling bottom hole assembly may be pulled out-of-hole, and a dedicated loss zone bottom hole assembly having at least one activation tool, and optionally, a packer above (closer to the surface of the well) the activation tool, may be run in-hole. A packer (or other type of downhole annular seal) may be provided above an activation tool to seal electrically activated lost circulation material below the packer, and thus hold electrically activated lost circulation material pumped downhole in the annular space between the activation tool and wellbore wall. After solidifying the electrically activated lost circulation material to plug the loss zone, the dedicated loss zone bottom hole assembly may be pulled out-of-hole, and a dedicated drilling bottom hole assembly may then be used to continue drilling. In some embodiments, a bottom hole assembly equipped with the activation tool could be removed from a wellbore and swapped for another dedicated bottom hole assembly in such a way that the bottom hole assembly equipped with the activation tool remains reusable.

The surface of the activation tool may also be designed in such a way that it does not bind with the solidifying lost circulation material. In one or more embodiments, the activation tool may be treated with an anti-adhesive to have a "phobic" surface prior to use. "Phobic" in this case means not able to bind with the solidifying lost circulation material, where there is no adhesion created between the activation tool and the solidified lost circulation material. In one or more embodiments, the electric field at the surface of the activation tool may be controlled such that there is no charge on the surface. In such embodiments, electrically activated lost circulation material may remain inactive near the surface of the activation tool and stay in the liquid phase, which may maintain some lubricity between the activation tool and the solidified lost circulation material to avoid adhesion between the two. In one or more embodiments, surfaces of the conductors may be designed in such a way that they do not bind with the solidifying lost circulation material, using the methods presented above of either anti-adhesive coatings or surface inactive electric fields. In one or more further embodiments, anti-adhesive coatings and surface inactive electric field methods may both be used.

In some embodiments, an outer surface of the tool may be tapered to make it easier to pull the tool out of the solidified lost circulation material. A taper or other beneficial geometry may be used as an alternative to or in addition to the anti-adhesive coatings mentioned above.

According to embodiments of the present disclosure, one or more activation tools may be used in the same run without the need to pull the drill string out-of-hole. For example, in some embodiments, multiple activation tools may be provided along a drill string. In some embodiments, a single activation tool may be provided along a drill string, where the activation tool may be designed for multiple uses, such as having expandable/retractable elements, treated non-binding surfaces, and/or inactive electric field surfaces, as described above.

The activation tools described above may be placed near a loss zone and used to emplace the electrically activated lost circulation material, for example, in a wireline operation or with the activation tool being part of a bottom hole assembly.

Downhole Systems for Electronic Activation of the Electrically Activated Lost Circulation Material As noted above, once the electrically activated loss control material is pumped to the loss zone, the solidification reaction may be electrically triggered. For that to occur, both communication and power transfer may be provided through the downhole activation tool.

Embodiments herein contemplate use of wired drill pipes to transmit power and/or communication to the activation tool, where the power may be delivered to wires or cables passing through the body of the isolation sleeve to the conductors. Other embodiments herein contemplate communicating with the activation tool through pressure pulses, as commonly used in the industry, and to deliver power to the conductors through a turbine generator to the activation tool. Yet other embodiments contemplate communicating with the activation tool through pressure pulses and to use a battery to deliver power to the activation tool when needed.

Figure 4A:
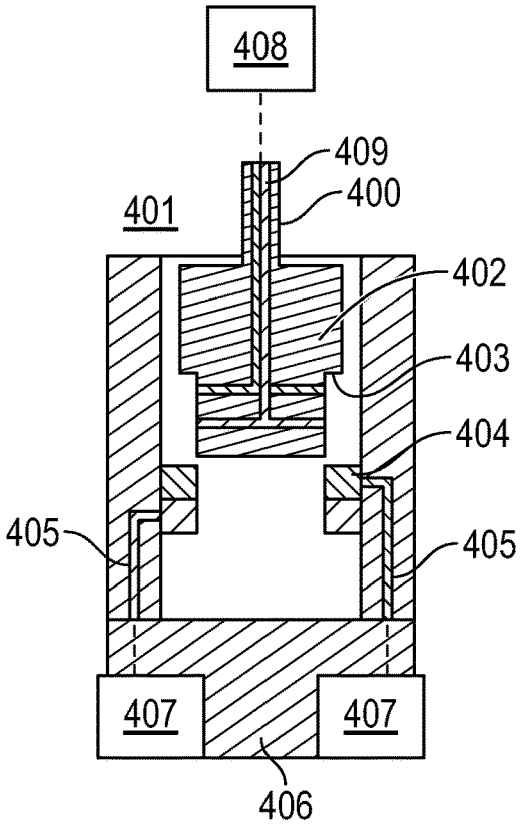
FIGS. 4A-4B show schematics of an activation wire-line plug used to deliver power to an activation tool through a dedicated seat, according to one or more embodiments herein.
Figure 4B:
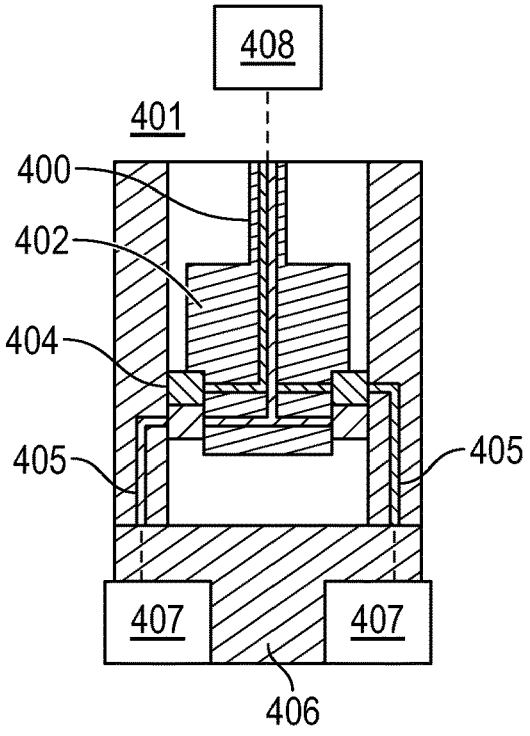

In yet other embodiments, the activation tool may be activated using an activation plug. The activation plug, for example, may be delivered via a wireline through the drill string to the activation tool, as illustrated in FIGS. 4A-4B.

The isolation sleeve may or may not be detachably connected around the outside of the activation tool body/sub. The activation tool 401 may include cables 405 that run from a terminus at an interior of the sub through the isolation sleeve 406 to the conductors 407. The cables 405 at the interior of the sub may be proximate a seat 404 on which an activation plug 402 may land. A wireline cable 400 may be connected to an activation plug 402. The activation plug 402 may include a corresponding shoulder 403 configured to mate with seat 404. Shoulder 403 may include terminals associated with respective cables 409 from a power source 408 and may be configured and arranged such that electrical communication from the power source 408 to the conductors 407 is achieved, forming a circuit with the cables 405 associated with the conductors 407. The seat 404 includes terminals associated with cables 405 that are connected to the conductors 407. The wireline cable includes multiple cables 409, depicted in FIGS. 4A-4B, that are connected to either anode electrodes or cathode electrodes. The cables 409 are used for communication with the conductors 407 and to supply electric power. FIG. 4A shows a wire-line activation plug 402 while run-in-hole, according to one or more embodiments herein. FIG. 4B shows the activation plug 402 after setting in the seat 404, where the terminals are aligned so as to send power and/or communication to the activation tool 401, according to one or more embodiments herein.

As noted above, in some embodiments, multiple activation tools may be distributed along a length of the drill string. Each of the multiple activation tools may include a seat for receiving a wireline activation plug. The number of activation tool subs and corresponding seats that are installed are not particularly limited. In one or more embodiments, when multiple activation tools are installed, the seat at the deepest section of a wellbore has a narrowest inner diameter of the seats in each of the multiple activation tools, and the seat or seats that are installed above the deepest one have a progressively wider inner diameter, upward toward the surface of the wellbore. In the instance of multiple seats/activation tools, an activation plug having an outer diameter that corresponds to the inner diameter of the seat in the sub proximate the loss zone may be sent downhole, such that the activation plug passes through any seats that are of a larger inner diameter to land on the proper activation tool to be used, setting in the associated seat.

Wireline systems of embodiments herein may also include communication cables configured to land on or connect to the activation tool seat to provide communication to the sub. For systems in which the activation tool is powered through turbine generators or batteries, a wireline system similar to that of FIGS. 4A and 4B may be used to provide only communications to the activation tool.

In one or more embodiments, the system with a bottom hole assembly also includes a packer, a clean out tool with a reamer, or both. When a packer is included in the system, the packer may seal the annular area between the drill string and the wellbore, and the electrically activated lost circulation material may be pumped into the wellbore below the packer. When a clean out tool with a reamer is included in the system, it may be used to drill out the equipment of the bottom hole assembly and the portion of the solid gel that forms in the wellbore annulus.

The downhole systems described above may be used in methods to activate lost circulation material, for example, using a wireline system or a drill string system after an electrically activated lost circulation material is emplaced within the wellbore proximate the loss zone. Further methods may be related to removal of the systems from the lost circulation zone after a solidification reaction.

Methods for Activating the Electrically Activated Lost Circulation Material Using Downhole Systems Methods for activation of an electrically activated lost circulation material may begin with placement of an activation tool near the loss zone or zones. After the activation tool has been placed, the electrically activated lost circulation material is emplaced. Emplacement of the lost circulation material occurs through pumping the electronically activated lost circulation material to a loss zone. As previously mentioned, in one or more embodiments, the pumping of the electrically activated lost circulation material may occur below a packer. A packer may be used with a suitable system in place such as a wire-line system, a drill string system, a pipe or coiled tubing system. In one or more embodiments, fluid circulation to pump the lost circulation material may be established immediately before delivering power. After the electrically activated lost circulation material is emplaced, the solidification reaction may be activated through a dedicated activation tool. To activate the activation tool, both communication and power transfer may be provided to the activation tool, for example, via an activation plug. Upon activation by introducing an electric field to the electrically activated lost circulation material, the fluid forms a solid gel in a solidification reaction. After the solid gel has been set, the activation tool may be removed or drilled through.

In some embodiments, an activation tool having a side-entry such as a seat with cables and electrodes may be positioned proximate a loss zone, and an activation plug on wire-line may be run to the seat. In these embodiments, the activation tool may be run on drill pipe to establish fluid circulation and enable the placement of the lost circulation material, and then the activation plug on wireline may be run through the drill pipe to deliver power to activation tool. The method using a wire-line system may transmit power and communication to the activation tool through the activation plug to make contact between the activation plug and seat, such as depicted in FIGS. 4A-4B.

In methods wherein multiple activation tools and wire-line activation plugs are used, multiple and independent activations of lost circulation material may occur in the same run without the need to pull the bottom hole assembly out of hole. This can be achieved by placing several activation tools along the drill string or wire-line as presented above.

One or more embodiments of methods to remove the activation tool and assembly may include using extendable and retractable conductors. After the conductors have activated the solidification reaction and a solid gel has been formed, the conductors can retract into the isolation sleeve and can be pulled up with the drill string or wire-line. In the case where excessive force would be needed to remove the activation tool, other methods below may be used. Excessive force in this instance is a force that causes damage to the activation tool or other downhole equipment. The force to remove the activation tool in one or more embodiments of the method may be decreased when equipped with an anti-adhesive or phobic surface coating.

One or more embodiments of methods to remove an activation tool may include inflation and deflation of the activation tool. The activation tool may be inflated to expand before activating the solidification of the electrically activated lost circulation material and may be deflated to return to the original smaller size upon completion of the solidification reaction. In addition to this, the electrodes in the inflatable and deflatable activation tool may have the ability to be extended and retracted. Using one or more embodiments of this method, activation of the lost circulation material may be followed by retracting the electrodes and deflating the activation tool. Following deflation, clean out may be performed and drilling may be resumed, such as for a drilling bottom hole assembly including an activation tool according to embodiments herein. Alternatively, for a dedicated loss circulation event bottom hole assembly including an activation tool, following deflation the activation tool may then be retrieved. Afterward, the solidified lost circulation material may be cleared out, and the activation tool can be used again to treat another loss zone or to repeat the treatment of the same zone if needed.

One or more embodiments of methods may include pulling a standard drilling bottom hole assembly out-of-hole and running in a dedicated bottom hole assembly having an activation tool. A clean out tool with a reamer may be installed below and/or above the activation tool with an optional packer above it. Electrically activated lost circulation material may be pumped in the bottom of the hole below the packer and activated using the activation tool of the dedicated bottom hole assembly. The dedicated bottom hole assembly may then be pulled-out-of-hole, reaming the solidified lost circulation material in the process, and the standard drilling bottom hole assembly may be used to continue drilling again.

Figure 5A:
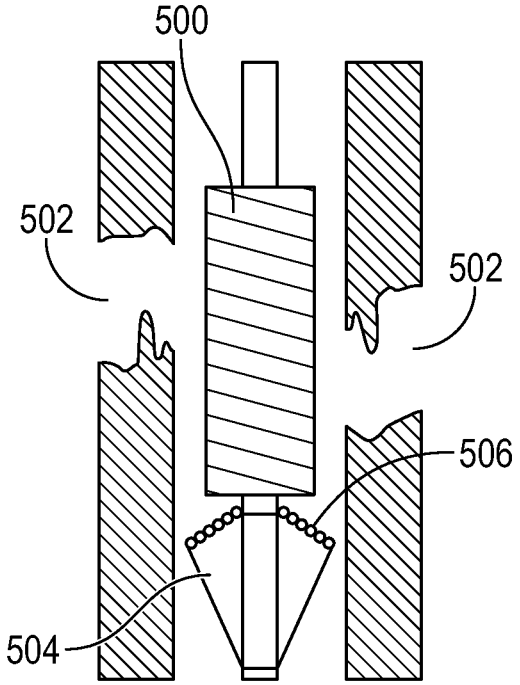
FIGS. 5A-5D show schematics of the operational sequence for cleaning out a stuck activation tool, according to one or more embodiments.
Figure 5B:
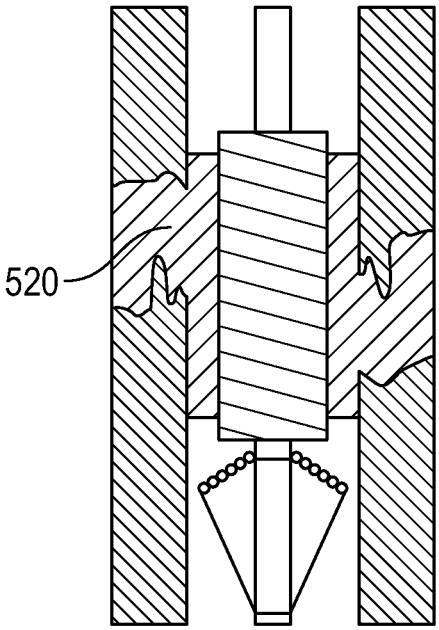
Figure 5C:
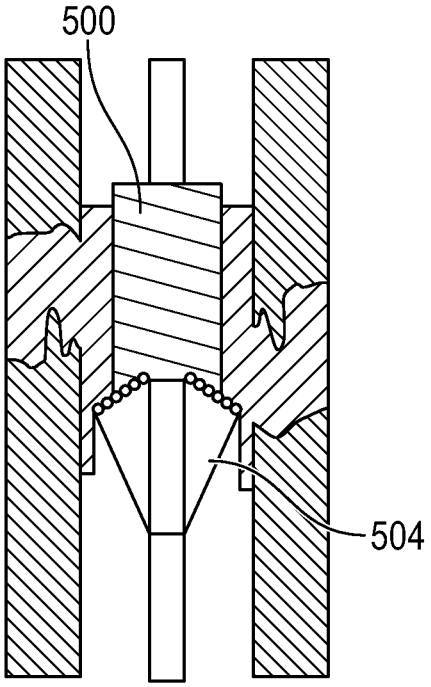
Figure 5D:
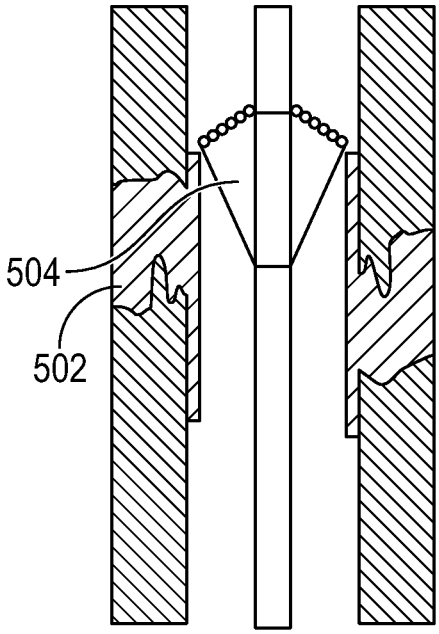

One or more embodiments of methods to remove the activation tool may include clearing the assembly system by drilling through the solidified lost circulation material and the activation tool, as follows. FIG. 5A-5D depicts methods related to an activation tool and solidified lost circulation material that is drilled-through. FIG. 5A shows an activation tool 500 that is positioned in a loss zone 502, represented by a fracture in the wellbore. The clean out tool and reamer 504 is shown below the activation tool 500; although, the clean out tool and reamer can be installed above the activation tool with cutting surfaces 506 pointed downward to the activation tool 500 instead. FIG. 5B shows an electrically activated lost circulation material that has been solidified 520 to fill the loss zone, shown as filling the gap in the wellbore fracture and the area in the wellbore annulus surrounding the activation tool 500. FIG. 5C shows the clean out tool and reamer 504 cutting into the surface of the activation tool (detached from the drill string) and solidified lost circulation material. FIG. 5D shows the cleaned-out and filled loss zone 502 that has been repaired, with the activation tool absent after being drilled through.

As previously presented, both an isolation sleeve and conductors of an activation tool 500 may be made of drillable materials, such as elastomers for the isolation sleeve and aluminum for the electrodes. A clean out tool with a reamer having a cutting surface 506 such as cutters or grinders faces the isolation sleeve either above or below the activation tool 500. In one or more embodiments, multiple clean out tools may be placed above and below the activation tool, with cutting surfaces facing the activation tool. After solidification of the lost circulation material, the isolation sleeve may be released, and the clean out tool with the reamer is used to drill out and clean the core of the solidified area as demonstrated in FIG. 5A-5D. In one or more embodiments, the clean out tool with a reamer drills through the activation tool.

A chemically activated lost circulation material may be governed, in part, by reaction rates of the interaction between chemicals and dissolution of the chemical components throughout the mixture. In contrast, embodiments herein utilize an electric field activation mechanism that allows for an immediate activation of the chemical components of a lost circulation material at a precise location in the wellbore. One or more embodiments of electrically activated lost circulation material may have an immediate activation from a supplied power source that is controlled by an on-demand communication source.

When a wellbore experiences a lost circulation event that may be fixed with immediate solidification of a lost circulation material, an electrically activated lost circulation material can be used with an activation tool system and methods according to embodiments herein. These methods are not limited or controlled by temperature such as is commonly the case when using a chemically activated lost circulation material. The accuracy of both timing and location of the activation of the solidification reaction may be controlled in one or more embodiments. As a non-limiting example, a first electrically activated lost circulation material can be activated instantaneously at a specific depth, while a second electrically activated lost circulation material can be activated at a lower depth precisely moments later. In one or more embodiments, electrically activated lost circulation materials can be activated at more than two depths within moments of each activation. In one or more embodiments, the loss zone, direction, and depth of treatment using the electrically activated lost circulation material and methods herein may be planned, controlled and measured.

One or more embodiments above use methods and systems that involve electric activation of an electrically activated lost circulation material, mechanical engagement of the solidification reaction and clean out, and chemical compositions of lost circulation materials. Thus, the disclosure presents methods that combine electrical, chemical, and mechanical methods for lost circulation.

One or more embodiments above use the electrical LCM in total lost circulation events, defined as not having any flow rate in the return line, regardless of loss rate. The use of the electrical LCM includes pulling out the BHA in one or more embodiments and running in hole again with a dedicated assembly, and/or at least includes stopping the drilling operations, rigging up wire-line, and running in and out of hole with the activation tool. Because these operations may be costly in view of time and labor, electrical LCM is used in instances with total lost circulation events or partial losses that may justify the cost of time and labor.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A system for emplacing an electrically activated lost circulation material within a wellbore, comprising:

an activation tool, comprising:

a non-conductive isolation sleeve having an inner bore;

electrodes, including anodes and cathodes, exposed to an outer surface of the non-conductive isolation sleeve;

conductive cables electrically connecting the electrodes to one of an anode terminal and a cathode terminal; and a seat extending into the inner bore;

an activation system, comprising:

an activation plug connected to a wireline, the activation plug having a shoulder configured to land on the seat of the activation tool;

wherein, when the activation plug is landed on the seat, conductive cables disposed within the activation plug are in electrical connection with one or more of the anode terminal and the cathode terminal; and a power source for providing electricity to the conductive cables disposed within the activation plug.

2. The system of claim 1, wherein the electrically activated lost circulation material comprises:

a plurality of particles suspended in a fluid phase, the plurality of particles comprising core particles having a nano-layer coating comprising urea; and a surfactant, wherein upon application of an electric field through the electrodes, the plurality of particles arrange to form a solid gel.

3. The system of claim 1, wherein the electrodes are affixed to the outer surface of the non-conductive isolation sleeve.

4. The system of claim 1, wherein the electrodes are extendable from within the activation tool to the outer surface of the non-conductive isolation sleeve.

5. The system of claim 1, wherein the activation system further comprises a mechanism configured to activate an extension and/or a retraction of the electrodes.

6. The system of claim 1, wherein one or more surfaces of the activation tool comprise an anti-adhesive coating.

7. The system of claim 1, wherein the outer surface of the non-conductive isolation sleeve has an anti-adhesive coating.

8. A system for emplacing an electrically activated lost circulation material within a wellbore, comprising:

a bottom hole assembly connected to a drill string;

an activation tool provided along the bottom hole assembly, the activation tool comprising:

electrodes, including anodes and cathodes, exposed to an outer surface of the activation tool;

conductive cables electrically connecting the electrodes to one of an anode terminal and a cathode terminal inside the activation tool; and an activation system, comprising:

conductive cables disposed within the drill string in electrical connection with one or more of the anode terminal and the cathode terminal; and a power source for providing electricity to the conductive cables disposed within the drill string.

9. The system of claim 8, wherein the electrodes are configured to apply an electric field to an electrically activated lost circulation material comprising a plurality of particles suspended in a fluid phase, each of particles within the plurality of particles comprising a core particle coated with a nano-layer of urea.

10. The system of claim 8, further comprising a packer above the activation tool.

11. The system of claim 8, further comprising a clean out tool positioned below the activation tool, wherein the clean out tool has a reamer.

12. The system of claim 8, wherein the activation tool is drillable.

13. A method for plugging a loss zone in a wellbore, the method comprising:

providing at least one activation tool proximate the loss zone, wherein the at least one activation tool comprises;

a non-conductive isolation sleeve having an inner bore;

electrodes, including anodes and cathodes, exposed to an outer surface of the non-conductive isolation sleeve; and conductive cables electrically connecting the electrodes to one or more electrode terminals;

circulating an electrically activated lost circulation material to the loss zone;

delivering electricity from a power source to electrodes of the activation tool via the conductive cables to generate an electric field around the electrically activated lost circulation material to solidify the electrically activated lost circulation material.

14. The method of claim 13, wherein the electrically activated lost circulation material comprises particles dispersed in a fluid phase, the particles comprising a core particle coated with a nano-layer of urea.

15. The method of claim 13, further comprising removing the at least one activation tool, comprising: drilling through the at least one activation tool and solidified electrically activated lost circulation material.

16. The method of claim 13, further comprising removing the activation tool after solidification of the electrically activated lost circulation material, the removing comprising retracting at least one component of the activation tool and pulling the activation tool up with a connected drill string.

17. The method of claim 13, wherein the power source is selected from the group consisting of a turbine generator, batteries, and cable wire.

18. The method of claim 13, wherein the at least one activation tool is provided along a drill string extending through the wellbore.

19. The method of claim 18, further comprising:

sending an activation plug on a wireline through the drill string to the at least one activation tool, wherein wireline conductive cables extend from the power source to one or more terminals on the activation plug; and electrically connecting the one or more terminals of the activation plug to the one or more electrode terminals of the activation tool.

20. The method of claim 18, wherein the at least one activation tool comprises multiple activation tools spaced along the drill string.

* * * * *